US005698180A

United States Patent [19]

Dixon

[11] Patent Number: 5,698,180

[45] Date of Patent: Dec. 16, 1997

[54] PIPER NIGRUM AND ACETIC ACID LACHRYMATOR

[75] Inventor: Michael W. Dixon, Lake Forest, Calif.

[73] Assignee: Gusty Winds Corporation, Costa Mesa, Calif.

[21] Appl. No.: 613,057

[22] Filed: Mar. 8, 1996

[51] Int. Cl.[6] ..... A61K 9/12

[52] U.S. Cl. ..... 424/43; 424/45; 514/918; 514/920; 514/937

[58] Field of Search ..... 424/43, 45, 405; 514/937, 918

[56] References Cited

U.S. PATENT DOCUMENTS

| | | | |
|---|---|---|---|
| 5,439,891 | 8/1995 | Kapil et al. | 514/31 |
| 5,470,589 | 11/1995 | Shi | 424/698 |
| 5,599,803 | 2/1997 | Hainrihar et al. | 514/70 |

FOREIGN PATENT DOCUMENTS 758634 2/1997 European Pat. Off. .

*Primary Examiner*—Raj Bawa
*Attorney, Agent, or Firm*—Morland C. Fischer

[57] ABSTRACT

Disclosed is a nontoxic piper nigrum and acetic acid liquid lachrymator solution that can be used defensively when dispensed as a spray to reliably fend off and temporarily incapacitate an attacker or lawbreaker without subjecting the targeted individual to permanent injury or death as might otherwise occur had the individual been sprayed with a conventional capsicum lachrymator. In the preferred embodiment the nontoxic lachrymator solution of the present invention comprises an approximately 15% by weight solution of piper nigrum (black pepper), an approximately 49% by weight water reduced solution of acetic acid (vinegar), a solvent/preservative comprising approximately 35% by weight ethyl alcohol and a telltale marking/aiming agent comprising approximately 1% by weight yellow food color. The nontoxic liquid lachrymator solution of the present invention is nonflammable and comprises approximately 63% by weight water.

5 Claims, No Drawings

PIPER NIGRUM AND ACETIC ACID LACHRYMATOR

BACKGROUND OF THE INVENTION

1. Field of the Invention

The present invention relates to a nontoxic piper nigrum and acetic acid containing liquid solution for use as a lachrymator when dispensed as a spray to reliably fend off and temporarily incapacitate an attacker or lawbreaker without subjecting the individual to permanent injury or death as might otherwise occur had the individual been sprayed with a conventional capsicum containing lachrymator.

2. Background Art

As an alternative to using lethal weapons and/or applying deadly force in nonlife threatening situations, law enforcement agencies, military services, private security companies, and private citizens concerned with self-defense have in the past turned to chemical tear gas containing lachrymators as a means to protect persons and property against attack and criminal activity. Lachrymators (also known as tear producing agents) effect the body's lacrimal glands, i.e. the tear ducts. However, available chemical tear gas lachrymators, such as the original "Chemical Mace" lachrymator, which consists of the chemical agents chloroacetophenone (CN) or ortho-chlorobenzalmalononitrile (CS), have been known to be ineffective in certain cases.

For example, chemical tear gas lachrymators have minimal effect on those under the influence of alcohol and/or drugs. Moreover, chemical tear gas lachrymators have had no effect on enraged or attacking animals. When used in law enforcement and self-defense applications, chemical tear gas lachrymators often cause those sprayed to become combative. Under ideal conditions, chemical tear gas lachrymators would cause the eyes of the targeted individual to sting and tear while, at the same time, irritating the skin surface and mucous membranes of the respiratory tract. However, chemical tear gas lachrymators require at least several seconds after being sprayed to become active thereby allowing the targeted individual sufficient time to inflict harm before disabling effects, if any, occur. What is more, chemical tear gas lachrymators are considered by some to have long term carcinogenic properties.

In order to overcome the aforementioned drawbacks that are inherent by using conventional chemical tear gas containing lachrymators, many law enforcement agencies, military services, private security companies and private citizens seeking a more effective means of self-defense have switched to a capsicum containing lachrymator. That is, an extract from chili peppers, known as oleoresin capsicum (OC), or just simply capsicum, has replaced chemical tear gas lachrymators ostensibly as a non-lethal defensive and disabling agent, because it has proven to be significantly more effective than chemical tear gas lachrymators. When packaged as a capsicum containing lachrymator, the aforementioned capsicum extract has been shown to be instantaneously active upon contact, and is effective most of the time against individuals who are under the influence of alcohol and most drugs. Similarly, the capsicum containing lachrymator has been shown to be effective most of the time against enraged animals.

In particular, and when dispensed, a capsicum containing lachrymator functions as an inflammatory agent rather than merely a chemical irritant in the manner of chemical tear gas containing lachrymators. Capsicum containing lachrymators are known to swell small vessels in the eyes causing a painful obscuring of vision which typically lasts for up to 30 to 60 minutes. More significantly, capsicum containing lachrymators inflame (i.e., swell) the mucous membranes of the mouth, nose and throat, also causing a heavy mucous discharge. However, this swelling of the targeted individual's mucous membranes, especially in the area of the throat, and specifically of the larynx, trachea and the mucous membranes of the bronchi and lungs (i.e., the respiratory tract), has created a significant and potentially life threatening problem when the breathing passages become restricted such that normal respiration is either significantly reduced or entirely cut off.

More particularly, there have been in excess of 60 known fatalities in the United States, alone, among those who have been exposed to capsicum containing lachrymators, usually used by law enforcement personnel and others acting under the color of law. In some of these cases, it is suspected that the fatalities were caused by the combination of alcohol and/or drug consumption along with the characteristic respiratory tract effects of the capsicum containing lachrymator. It is thought by some that other contributing factors to the high number of fatalities among the individuals who were exposed to the capsicum containing lachrymators may include an underlying medical condition in combination with the capsicum containing lachrymator and/or an overexposure to the capsicum spray by over zealous law enforcement personnel. In each of these fatalities, where the individual was exposed to the capsicum containing lachrymator just prior to death, the individual died of respiratory failure, i.e., asphyxiation.

One example of a capsicum containing lachrymator that is suitable to be packaged within and dispensed from a conventional pressurized aerosol canister is available by referring to U.S. Pat. No. 5,217,708 issued Jun. 8, 1993.

Clearly, there exists a need for a fast acting defensive lachrymator spray that will reliably fend off and temporarily incapacitate an attacker or lawbreaker without subjecting the individual to permanent injury or death, regardless of how much spray is used or how often the individual is exposed thereto, whether or not the individual is under the influence of alcohol and/or drugs or has an acute or chronic medical condition that is not immediately apparent prior to being sprayed. Such a defensive lachrymator spray needs to be effective, but most significantly it also needs to be safe for those exposed to it under all circumstances typically expected to be encountered.

SUMMARY OF THE INVENTION

Briefly, and in general terms, a nontoxic water based piper nigrum and acetic acid containing liquid lachrymator solution is disclosed that can be used defensively as a reliable alternative to chemical tear gas containing lachrymators and capsicum containing lachrymators. The piper nigrum and acetic acid liquid lachrymator solution of this invention is suitable to be dispensed as a spray from a conventional pressurized aerosol canister or container to immediately fend off and temporarily incapacitate an attacker or lawbreaker or an enraged animal without subjecting the individual to permanent injury or death. More particularly, and unlike conventional capsicum containing lachrymators now in use, the disclosed lachrymator of the present invention will instantly effect the eyes of the targeted individual without inflaming the mucous membranes of the mouth, nose, throat and respiratory tract so as to advantageously avoid cutting off the individual's air supply which could lead to death by asphyxiation. What is more, the piper nigrum and acetic acid lachrymator solution will produce no long term or ill effects against those under the influence of alcohol, drugs, or a combination thereof or those who have an acute or chronic medical condition. Furthermore, the targeted individual will not be susceptible to permanent disability regardless of how often he is sprayed and the volume of spray to which he is exposed.

In the preferred embodiment the piper nigrum and acetic acid liquid lachrymator solution contains two active ingredients, an approximately 15% by weight solution of piper nigrum and an approximately 49% by weight solution of acetic acid. The piper nigrum solution may be derived by using finely ground ordinary household black pepper that has been soaked in distilled water for 24 to 48 hours. The solution is then filtered and the resulting liquid extract separated from the residue. The acetic acid solution may be ordinary household vinegar such as distilled white vinegar that has been reduced with water to a standard 5% acidity. A solvent and preservative consisting of approximately 35% by weight ethyl alcohol is combined with the piper nigrum and acetic acid solutions so as to enhance and preserve the effectiveness of these active ingredients. Lastly, an optional aiming and marking agent consisting of approximately 1% by weight of ordinary household FDA food color is included so that the targeted individual can be marked with a nontoxic telltale indicator for later identification should he flee the scene of an attack or crime. Moreover, the food color, because of its inherent highly visible nature, enables the spray to be more accurately aimed towards the targeted site.

DETAILED DESCRIPTION

The piper nigrum and acetic acid liquid lachrymator solution which forms the present invention has the following food grade ingredients. One of a pair of active ingredients of the liquid lachrymator solution is an approximately 15% by weight solution of piper nigrum. The other active ingredient is an approximately 49% by weight solution of acetic acid. As an important aspect of the present invention, the active ingredients of piper nigrum and acetic acid solutions replace the active ingredient capsicum that has been commonly used in the manufacture of many capsicum lachrymators.

By virtue of the foregoing, the piper nigrum and acetic acid liquid lachrymator solution, when properly dispensed, will cause the eyes of the targeted individual to begin to immediately tear and sting, effectively but temporarily obscuring the individual's vision for approximately 10 to 20 minutes. However, the mucous membranes of the targeted individual will, significantly, not be susceptible to inflammation and swelling in the area of the mouth, nose, throat and respiratory tract so as to significantly reduce the possibility that the individual's air supply will be restricted or even cut off altogether. In this same regard, the properly dispensed piper nigrum and acetic acid lachrymator solution will not cause, induce, or in any way contribute to death as a consequence of asphyxiation, regardless of whether or not the effected individual has consumed alcohol and/or drugs or combinations thereof, or has an acute or chronic medical condition, or has been improperly exposed to an excessive volume of dispensed lachrymator spray by over zealous law enforcement personnel. What is even more, the piper nigrum and acetic acid liquid lachrymator solution of this invention is extremely nontoxic, so much so that it could even be taken orally by a normally healthy adult with no harmful effects, other than possible gastric upset if an excessive volume were consumed. Unlike many capsicum lachrymator compositions, the water based piper nigrum and acetic acid lachrymator composition is essentially nonflammable, having an ignition point greater than 500 degrees Fahrenheit.

The piper nigrum and acetic acid lachrymator solution of the present invention contains a solvent and preservative which, in the preferred embodiment, is approximately 35% by weight ethyl alcohol. The ethyl alcohol solvent also functions as a preservative and enhances and preserves the effectiveness of the above identified active ingredients.

Lastly, the piper nigrum and acetic acid lachrymator solution of this invention includes a nontoxic marking agent which, when combined with the other ingredients and dispensed, enables the targeted individual to be suitably marked for later identification in cases where the individual should flee the scene. Moreover, the marking agent also serves as a highly visible aiming mechanism to enable the spray to be more accurately directed towards a designated target area. In the preferred embodiment, the marking/aiming agent is approximately 1% by weight FDA yellow food color. Of course, other FDA food colors besides yellow may be used to mark the targeted individual with a telltale indicator.

To manufacture the piper nigrum and acetic acid lachrymator solution of the present invention, the piper nigrum solution described above is made by mixing the finely ground whole dried fruit of the East Indian piper nigrum plant (i.e., ordinary household black pepper) with distilled water. The volume of distilled water should be limited to that needed to completely cover the finely ground piper nigrum. The piper nigrum is left to soak in the distilled water, preferably at room temperature, but not freezing, for at least 24 hours up to a maximum of 48 hours. It has been found that soaking the piper nigrum for longer than 48 hours provides little or no added benefit.

While the piper nigrum is soaking in the distilled water, the solution should be completely stirred for about one minute approximately every eight hours. At the conclusion of the soaking period, the liquid piper nigrum solution is filtered and separated from the finely ground residue. A conventional paper filter, like that used in brewing coffee or the like, is suitable for completing the filtering step. The resulting liquid extract is the piper nigrum solution which is then available to be mixed with the other ingredients.

The acetic acid solution described above may be ordinary household vinegar. The solution consists of distilled white vinegar reduced with water to a standard 5% acidity.

The ethyl alcohol solvent and preservative may be ordinary denatured alcohol consisting of approximately 99.9% ethyl alcohol and approximately 0.1% tertiary butyl alcohol and denatonium benzoate.

Lastly, the FDA yellow food color marking and aiming agent that has been described above is ordinary household yellow food color typically consisting of water, propylene glycol, FD&C yellow No. 5, FD&C red No. 40, and 0.1% propylparaben used as a preservative.

The piper nigrum and acetic acid solutions are blended together with the ethyl alcohol and the marking/aiming agent. The resulting nontoxic liquid lachrymator solution can then be contained or stored in a conventional pressurized aerosol canister or container to be dispensed therefrom as a nontoxic lachrymator spray. However, the manner in which the piper nigrum and acetic acid lachrymator solution is dispensed is not to be considered as a limitation of this invention.

It may be appreciated that the piper nigrum and acetic acid lachrymator solution contains no ozone depleting substances such as chlorofluorocarbons (CFC's), and because it is approximately 63% by weight water, making it substantially water based, it is nonflammable both as a liquid solution and when dispensed. Further, the disclosed lachrymator is very stable, not separating, spoiling or losing its effectiveness over time and capable of functioning through a normal range of temperatures. Moreover, no adverse reactions or interactions have been observed between the various components. All active ingredients of the present invention are FDA approved food grade ingredients and are completely non-toxic (i.e. not capable of producing or contributing to permanent injury or death), both as a liquid solution and when dispensed, and can be disposed of in a conventional manner.

It will be apparent that while a preferred embodiment of the invention has been described, various modifications and changes may be made without departing from the true spirit and scope of the invention. In this regard, it should be recognized that the piper nigrum and acetic acid lachrymator solution disclosed herein may include any lachrymator type product containing different percentages of piper nigrum and/or acetic acid that are suitable to be utilized for defensive purposes. Therefore, the particular percentages of the ingredients listed above are for purposes of example and are not intended to be a limitation of this invention. Also, as used herein the term "spray" can include any form in which a lachrymator product may be dispensed such as, but not limited to, spray, stream, mist or fog.

Having thus set forth the preferred embodiment, what is claimed is:

1. A liquid lachrymator to be delivered as an aerosol to a targeted individual to temporarily incapacitate the individual by causing the eyes of the individual to sting and tear without impairing the mucous membranes of the throat and respiratory tract, said liquid lachrymator comprising an aqueous solution consisting of approximately 49% by weight acetic acid that is reduced to 5% acidity, approximately 15% by weight piper nigrum that is obtained by soaking household black pepper in water for 24 to 48 hours and separating the liquid extract therefrom, and approximately 35% by weight ethyl alcohol as a solvent.

2. The liquid lachrymator recited in claim 1, wherein said acetic acid is vinegar.

3. The liquid lachrymator recited in claim 1, further comprising a marking/aiming agent to leave an identifying mark on the targeted individual to whom said liquid lachrymator is delivered and assist in aiming and facilitate said delivery.

4. The liquid lachrymator recited in claim 3, wherein said marking/aiming agent includes approximately 1% by weight food color.

5. The liquid lachrymator recited in claim 1, comprising approximately 63% by weight water.

* * * * *